US005694795A

United States Patent [19]

Knopp

[11] Patent Number: 5,694,795

[45] Date of Patent: Dec. 9, 1997

[54] DRIVE MECHANISM FOR A HOUSEHOLD WASHER-DRYER

[75] Inventor: Dieter Knopp, Berlin, Germany

[73] Assignee: Bosch Siemens Hausgeraete GmbH, Munich, Germany

[21] Appl. No.: 549,058

[22] Filed: Oct. 27, 1995

[30] Foreign Application Priority Data

Oct. 27, 1994 [DE] Germany ..... 44 38 425.4

[51] Int. Cl.[6] ..... D06F 37/30

[52] U.S. Cl. ..... 68/140; 474/85

[58] Field of Search ..... 68/140; 34/601; 474/84, 85, 88

[56] References Cited

U.S. PATENT DOCUMENTS 2,994,216 8/1961 Morton ..... 68/140

3,382,587 5/1968 Curtis ..... 34/139

*Primary Examiner*—Philip R. Coe

*Attorney, Agent, or Firm*—Herbert L. Lerner; Laurence A. Greenberg

[57] ABSTRACT

A drive mechanism for a household washer-dryer includes an at least approximately horizontally rotatably supported tub having a tub jacket and a tub axis. A gear pinion has a drive belt being wrapped around the tub jacket for driving the tub in opposite directions. A large pulley is connected to the gear pinion, is fixed against rotation relative to the gear pinion and is supported on a common axis with the gear pinion. An electric drive motor has a motor pinion with an axis. A gear belt is driven by the motor pinion for driving the large pulley. The common axis is movably guided axially parallel and is spring-loaded in a direction toward an increase in spacings between the common axis and the axis of the motor pinion as well as between the common axis and the tub axis.

8 Claims, 3 Drawing Sheets

DRIVE MECHANISM FOR A HOUSEHOLD WASHER-DRYER

BACKGROUND OF THE INVENTION

Field of the Invention

The invention relates to a drive mechanism for a household washer-dryer, having an at least approximately horizontally rotatably supported tub which is drivable in one direction or in reverse by a drive belt being driven by a gear pinion and being wrapped around a jacket of the tub, the gear pinion is connected to a large pulley, is fixed against rotation relative to the large pulley and is supported on a common axis with the large pulley, and the large pulley in turn is driven through a gear belt by a motor pinion of an electric drive motor.

One such drive mechanism is known from U.S. Pat. No. 3,382,587. In that device, the spacings between the axes of the motor pinion and the gear and between the gear and the tub are permanently set. In assembling the drive mechanism, the gear belt and the tub drive belt must therefore be tensed through the use of an adjusting device because the dimensions available for installation and the lengths of the belts are subjected to tolerances. If the desired belt tensions for the requisite transmission of force are to be adhered to, the tolerances must be compensated for by adjustment. Additionally, over a relatively long service life the belts are subject to persistent lengthwise expansion, which leads to a lessening of the belt tensions and thus to a lowering of the forces that can be transmitted, and finally to the destruction of the belts, if the axis spacings are permanently set.

In order to avoid such length differences, tension rollers which have already been used (German Published, Non-Prosecuted Patent Application DE-OS 22 07 372) bear on the applicable back side of the belt through the use of one or more spring-loaded levers. Besides that kind of additional expense and the flexing that occurs, which arises from contrary deflection in comparison with the way in which the belt wraps around the pinion, most tension rollers that are not already overly complicated have one undesirable property: They cause the drive pinion or the tension roller to run onto the incoming run of the belt, thus decreasing the forces that can be transmitted.

SUMMARY OF THE INVENTION

It is accordingly an object of the invention to provide a drive mechanism for a household washer-dryer, which overcomes the hereinafore-mentioned disadvantages of the heretofore-known devices of this general type and which has an adjustment-free construction that, even after long service of the drive belts, does not need to be retightened without a loss in terms of the forces that can be transmitted.

With the foregoing and other objects in view there is provided, in accordance with the invention, a drive mechanism for a household washer-dryer, comprising an at least approximately horizontally rotatably supported tub having a tub jacket and a tub axis; a gear pinion having a drive belt being wrapped around the tub jacket for driving the tub in opposite directions; a large pulley being connected to the gear pinion, being fixed against rotation relative to the gear pinion and being supported on a common axis with the gear pinion; an electric drive motor having a motor pinion with an axis; and a gear belt being driven by the motor pinion for driving the large pulley; the common axis being spaced apart from the axis of the motor pinion by a first spacing and being spaced apart from the tub axis by a second spacing, and the common axis being movably guided axially parallel and being spring-loaded in a direction toward an increase in the first and second spacings.

Such an embodiment of the drive mechanism automatically compensates for tolerances that are inherent in the system and for additional tolerances in changes in length of the belts during progressive use of the washer-dryer. One operation which is otherwise provided for in the course of assembly, by which the axis spacings for the drive belts must be especially adjusted, can then be disposed with. Due to the invulnerability of the drive mechanism of the invention to long-term tolerances in terms of belt length changes, a number of service calls that are otherwise needed for retightening the belts is also dispensed with.

In accordance with another feature of the invention, the common axis is located in the vicinity of the free end of a lever which is supported by one arm. Combining the mobility of the common axis in both of these respects in a lever which is supported by one arm, simplifies the construction as compared with known proposals and gains additional certainty in terms of adhering to the transmission forces that are intended.

In accordance with a further feature of the invention, in order to adhere to a defined tension force in the gear belt, during operation as intended, the pivot point of the lever and the common axis, together with the pivot point of the motor pinion, are located at least approximately on one straight line.

In accordance with an added feature of the invention, the simplicity of the construction with the configuration on a lever supported by one arm is demonstrated in particular by representing the spring loading with respect to the tub axis by a tension spring being fastened between a fixed housing part and an outermost free end of the lever.

In accordance with an additional feature of the invention, the simplicity of the construction in the spring loading of the gear belt is demonstrated in two alternatives, in one of which spring loading with respect to the axis of the motor pinion is represented by a compression spring fastened between the pivot point of the lever and the lever arm, and in the other of which it is represented by a compression spring fastened between the pivot point of the large pulley and a fixed bearing plate on the lever arm. Admittedly this does appear to make for a complicated construction of the lever arm. However, since the lever arm is a die-cast aluminum part, its complexity is restricted to the one-time production of the casting tool.

In accordance with yet another feature of the invention, only a single additional component is needed because the pivot point for the large pulley and the gear pinion is mounted on a slide being guided on the lever at least approximately in the direction of the axis of the motor pinion.

In accordance with a concomitant feature of the invention, the slide has a chamber with a spring support for the compression spring which is mounted remote from the pivot point, and a fixed counter support of the spring is located on the lever near an oblong slot provided in the guide of the slide that is meant to be penetrated by the lever with the gear shaft.

Other features which are considered as characteristic for the invention are set forth in the appended claims.

Although the invention is illustrated and described herein as embodied in a drive mechanism for a household washer-dryer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
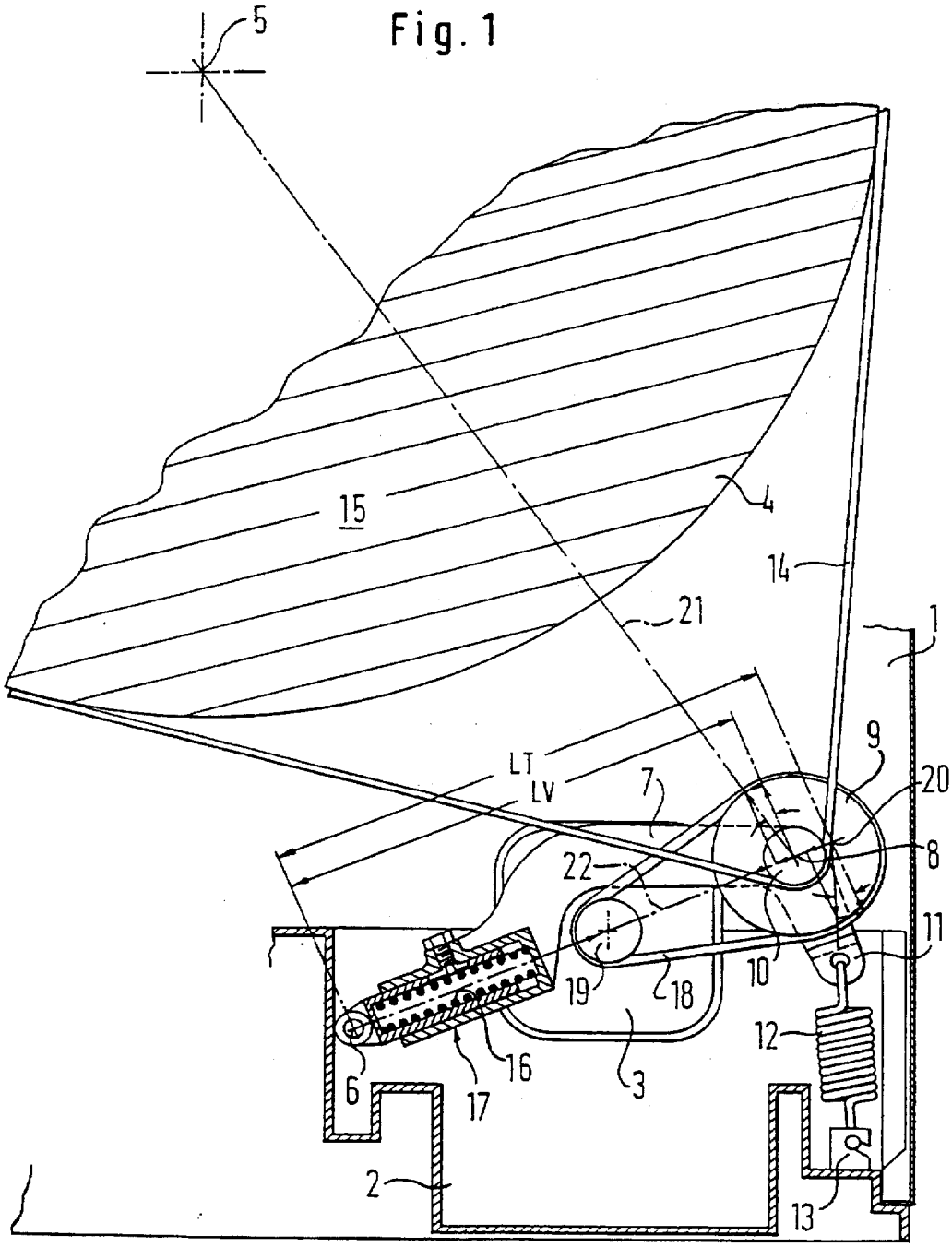
FIG. 1 is a fragmentary, diagrammatic, longitudinal-sectional view of a drive mechanism according to the invention, with a unilaterally supported lever, which is longitudinally displaceably interrupted at its bearing point and is provided with a compression spring for tightening a gear belt.

Referring now to the figures of the drawing in detail and first, particularly, to FIG. 1 thereof, there is seen a base 2 of a bottom unit which is built into a lower region of a housing 1 of a washer-dryer. A drive motor 3 for a tub 4 rests in the bottom unit. The tub 4 in turn is rotatably supported about an axis 5 on a non-illustrated housing component, which is disposed remote from the base 2. A lever 7 is also supported by one arm at a pivot point 6 of the base part 2, and in an operating position thereof a straight line 22 passes through an axis of the pivot point 6, an axis of the drive motor 3 and a common axis 8 of a large pulley 9 and of a gear pinion 10. The common axis 8 is disposed in the vicinity of a free end 11 of the lever 7 which is supported by one arm. The free end 11 of the lever 7 is engaged by one end of a tension spring 12 having another end which is suspended from a hook 13 in the base part 2. Through the use of this spring 12, the gear pinion 10 is pulled into a drive belt 14 for the tub 4. As a result, the belt 14 remains constantly tensed, without requiring any adjustment whatever. A circular cross-sectional area 15 of the tub represents a tub disk around which the belt 14 wraps, and which is automatically located in the same plane as the gear pinion 10.

The lever 7 is lengthened by a compression spring 16 which is guided in a double-walled sleeve 17, in such a way that the large pulley 9 stretches a gear belt 18 between itself and a motor pinion 19. As a result, the gear belt 18 also remains constantly tensed without adjustment.

The tension of the belts 14 and 18 is determined in part by the geometry of the gear parts and substantially by the tensional forces of the springs 12 and 16.

Figure 2:
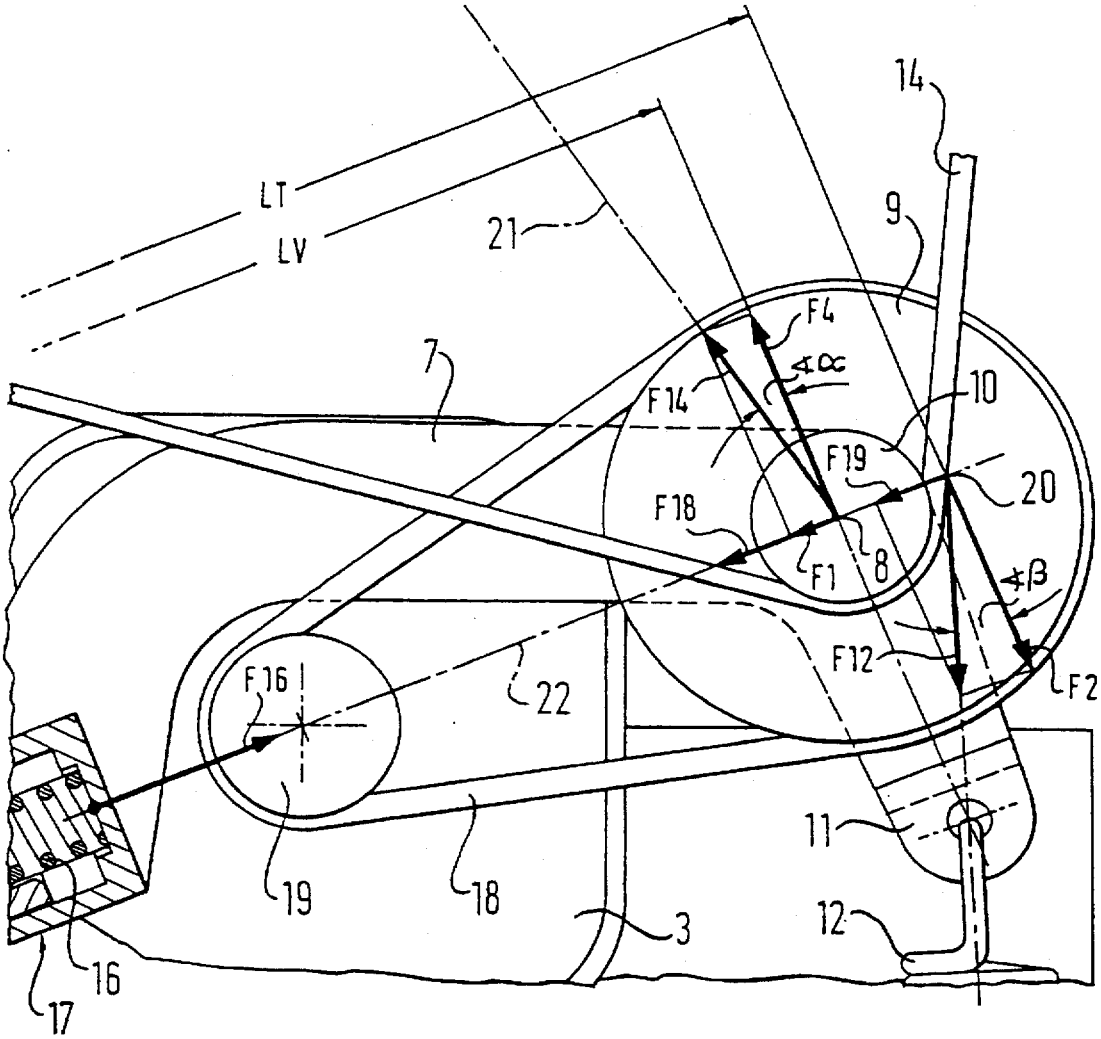
FIG. 2 is an enlarged view of a portion of the gear of FIG. 1, for explaining force conditions at a common axis.

In order to explain the force conditions, the gear region of FIG. 1 is shown on a larger scale in FIG. 2. The torque forces that must be transmitted from the motor 3 to the large pulley 9 and from the gear pinion 10 to the jacket of the tub 4 determine the requisite tension for each of the belts 18 and 14, respectively. The tension for the belt 18 is represented by a vector F18, and the tension for the belt 14 is represented by a vector F14. The requisite spring forces can be calculated from these two known variables, from a spacing LT from the pivot point 6 of the lever 7 to a fictitious engagement point 20 of a force F12 of the tension spring 12 along the straight line 22 and from a spacing LV from the pivot point 6 to an engagement point of the tension of the belt 14 in the common axis 8 of the gear. The spring forces can be calculated as follows:

The axis 8 is engaged by the tensional force F14 of the belt 14, which is located precisely on a connecting line 21 between the axis 8 and the axis 5 of the tub 4. If this force vector F14 is broken down into normal forces F1 and F4, then a further vector F1 pointing in the direction of the pivot point 6 of the gear lever can be ascertained. This vector is obtained from the following formula:

$$F1=F14\times_{sin\alpha} \tag{1}$$

In this formula, α is the angle between the belt tension force F14 and the normal force F4 to the straight line 22.

The spring force F12 is broken down into the vector F2, which is the corresponding normal force to the straight line 22 at the engagement point 20 of the intersection of the imaginary axis of the spring 12 and the straight line 22, and the vector F19, which can finally be calculated from the existing triangle of forces at an angle β. In this case, $$F19=F12\times_{sin\beta} \tag{2}$$

Since the force F12 is not known, this force must also first be calculated. It is obtained from the formula:

$$F12=\frac{F2}{\cos\beta} \tag{3}$$

The vector F2 is not known either, but can be calculated by the following formula:

$$F2=F4\times\frac{LV}{LT}\ ; \tag{4}$$

because the forces engaging the end of the lever 7 must be in equilibrium, since the torque at the axis 8 through the lever arm LV must be identical to the torque at the engagement point 20 above the lever arm LT. From this and from equations 2–4, the result is then the following formula for the force F19:

$$F19=\frac{LV}{LT}\times F14\times_{cos\alpha}\times\frac{\sin\beta}{\cos\beta} \tag{5}$$

or $$F19=\frac{LV}{LT}\times F14\times_{cos\alpha}\times_{tan\beta} \tag{6}$$

Finally, the given belt tensional force F18 and the force components F1 and F19 calculated in accordance with equations 1 and 6 add up to a common force component, which must use equivalent weight to counteract the force F16 to be brought to bear by the compression spring 16 of the lever 7:

$$F16=F18+F1+F19 \tag{7}$$

Figure 3:
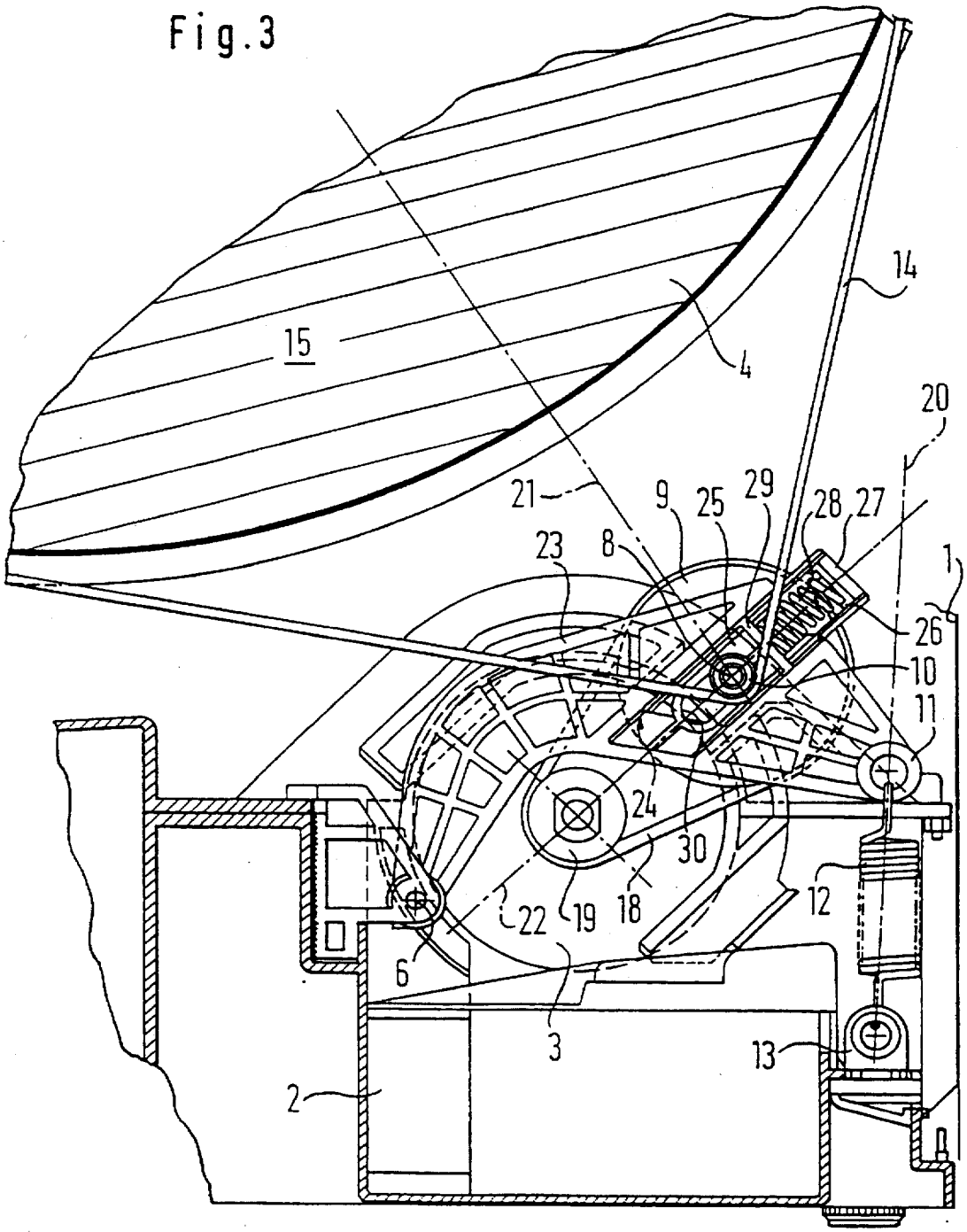
FIG. 3 is a fragmentary, longitudinal-sectional view of a drive mechanism that is formed differently from FIGS. 1 and 2, in which the common axis is disposed on a spring-loaded slide being guided in the lever.

FIG. 3 shows another exemplary embodiment for a drive mechanism according to the invention. In the FIG. 3 embodiment, a lever 23 which is supported by one arm is not inherently-resiliently supported at its pivot point 6, but instead the lever 23 is intrinsically rigid. However, in the vicinity of its lever end 11, it has a sliding block guide 24 with a center axis which points approximately at the axis of the motor 3 in the operating position of the lever 23. The sliding block guide 24 receives a slide 25, to which a bearing for the large pulley 9 and for the gear pinion 10 is secured. An oblong slot 30 is provided in the guide 24 of the slide 25. Through the use of this slide 25, the gear bearing can therefore be moved back and forth in the direction of the center axis of the sliding block guide 24. The slide 25 has an end 26 protruding out of the lever 23 which carries a counterpart bearing bridge 27 for a compression spring 28 that is supported on a bearing plate 29 of the lever 23. The compression spring 28 therefore pulls the large pulley 9 into the belt 18 through the gear bearing and the slide 25. At the same time, through the use of the tension spring 12 at the end 11 of the lever 23, the gear pinion 10 is pulled into the belt 14.

Since the dimensions are completely different as compared with the exemplary embodiment of FIGS. 1 and 2, different spring tensions result in the exemplary embodiment shown in FIG. 3. However, the fundamental construction of the drive mechanism according to the invention and the method of calculation for the spring forces are identical.

I claim:

1. A drive mechanism for a household washer-dryer, comprising:

an at least approximately horizontally rotatably supported tub having a tub jacket and a tub axis;

a gear pinion having a drive belt being wrapped around said tub jacket for driving said tub in opposite directions;

a large pulley being connected to said gear pinion, being fixed against rotation relative to said pinion and being supported on a common axis with said gear pinion;

an electric drive motor having a motor pinion with an axis;

a gear belt being driven by said motor pinion for driving said large pulley; and said common axis being spaced apart from said axis of said motor pinion by a first spacing and being spaced apart from said tub axis by a second spacing, and said common axis being movably guided and being spring-loaded in a direction toward an increase in said first and second spacings, said increase in said first and second spacings being independent of each other.

2. A drive mechanism for a household washer-dryer, comprising: an at least approximately horizontally rotatably supported tub having a tub jacket and a tub axis;

a gear pinion having a drive belt being wrapped around said tub jacket for driving said tub in opposite directions;

a large pulley being connected to said gear pinion, being fixed against rotation relative to said pinion and being supported on a common axis with said gear pinion;

a lever being supported by one arm and having a free end, said common axis being disposed in the vicinity of said free end;

an electric drive motor having a motor pinion with an axis;

a gear belt being driven by said motor pinion for driving said large pulley; and said common axis being spaced apart from said axis of said motor pinion by a first spacing and being spaced apart from said tub axis by a second spacing, and said common axis being movably guided and being spring-loaded in a direction toward an increase in said first and second spacings.

3. The drive mechanism according to claim 2, wherein said lever has a pivot point, and said pivot point of said lever, said common axis and said axis of said motor pinion are located at least approximately along a straight line during operation.

4. The drive mechanism according to claim 2, including a fixed housing part, and a tension spring being fastened between said fixed housing part and said free end of said lever for spring-loading said common axis relative to said tub axis.

5. The drive mechanism according to claim 2, including a lever arm of said lever, and a compression spring being fastened between said pivot point of said lever and said lever arm for spring-loading said common axis relative to said axis of said motor pinion.

6. The drive mechanism according to claim 2, including a lever arm of said lever, a fixed bearing plate on said lever arm, and a compression spring being fastened between said common axis and said fixed bearing plate for spring-loading said common axis relative to said axis of said motor pinion.

7. The drive mechanism according to claim 6, including a slide being guided on said lever at least approximately in the direction of said axis of said motor pinion, said common axis of said large pulley and said gear pinion being mounted on said slide.

8. The drive mechanism according to claim 7, wherein said slide has a chamber-like end with a counterpart bearing bridge for said compression spring being mounted remote from said common axis, said slide has a guide with an oblong slot formed therein for penetration of said lever with said common axis, and said lever has a fixed bearing plate for said compression spring near said oblong slot.

* * * * *